US005743355A

United States Patent [19]

McDonnell et al.

[11] Patent Number: 5,743,355

[45] Date of Patent: Apr. 28, 1998

[54] RETRACTABLE LADDER

[76] Inventors: Charles A. McDonnell, 7 Post Ct.; Leonard Silverman, 17 Renfrew Rd., both of New City, N.Y. 10956

[21] Appl. No.: 693,792

[22] Filed: Jul. 31, 1996

[51] Int. Cl.[6] ..... E06C 1/00

[52] U.S. Cl. ..... 182/195; 182/210; 182/211; 182/228

[58] Field of Search ..... 182/166, 195, 182/207, 209, 210, 211, 228; 52/118, 121

[56] References Cited

U.S. PATENT DOCUMENTS

| | | | |
|---|---|---|---|
| 1,712,942 | 5/1929 | Smith . | |
| 2,194,856 | 3/1940 | Kostuk | 228/17 |
| 2,542,398 | 7/1951 | Crumpton | 228/39 |
| 2,858,154 | 10/1958 | Johansson | 287/58 |
| 2,993,561 | 7/1961 | Watson | 182/195 |
| 3,039,186 | 6/1962 | Stoyer et al. | 29/520 |
| 3,774,720 | 11/1973 | Hovey | 182/91 |
| 3,786,899 | 1/1974 | Zenhausern | 182/93 |
| 3,862,670 | 1/1975 | Hovey | 182/89 |
| 4,002,223 | 1/1977 | Bernkrant | 182/156 |
| 4,119,177 | 10/1978 | Andersson | 182/195 |
| 4,389,134 | 6/1983 | Colas | 403/253 |
| 4,406,097 | 9/1983 | Meston | 52/118 |
| 4,597,687 | 7/1986 | Colas | 403/242 |
| 4,627,149 | 12/1986 | Colas | 29/516 |

FOREIGN PATENT DOCUMENTS

| | | |
|---|---|---|
| 223555 | 8/1959 | Australia . |
| 1175422 | 3/1959 | France . |
| 593953 | 5/1959 | Italy . |

*Primary Examiner*—Alvin C. Chin-Shue
*Assistant Examiner*—Richard M. Smith
*Attorney, Agent, or Firm*—Morgan & Finnegan, L.L.P.

[57] ABSTRACT

A retractable ladder having a low coefficient of friction plastic bushing is received within a coupling that joins a ladder rung to the associated longitudinal stile. The coupling is press fitted to the bushing, compressing a portion of the bushing against the stile, slightly deforming the adjoining portion of the stile to lock the assembly together. A latch having an inwardly sloping surface locks the ladder stiles in an extended condition and cannot be withdrawn to retract the ladder when the ladder is supporting a normal load. Dampers having orifices also are mounted in some or all of the hollow stiles to regulate the flow of air from the retracting stiles and, in this way to retard the velocity with which the ladder retracts to a predetermined, safe value.

5 Claims, 5 Drawing Sheets

RETRACTABLE LADDER

BRIEF SUMMARY OF THE INVENTION

This invention relates to retractable ladders and, more particularly, to a selectively retractable ladder with a low coefficient of friction plastic bushing secured within a bracket in which bushing, bracket, and underlying stile are deformed to prevent undesirable ladder disassembly; in which the outer ends of the ladder's locking bolts slope upwardly in order to prevent accidental ladder retraction; and with dampers that have orifices, the dampers being mounted in the hollow stiles in order to control ladder retraction speed by regulating airflow from the stiles as the ladder is retracting, and the like.

The need has been recognized for a number of years to provide a low coefficient of friction bearing surface for the vertical components, or stiles, on a retractable ladder. For example, U.S. Pat. No. 3,786,899 granted Jan. 22, 1974 to H. Zernhausen for "Ladder" shows a nylon sheath compressed between a vertical stringer and a connecting element that joins a ladder rung to the stringer. In spite of the compressed nylon sleeve, the lack of any means for keeping associated pairs of rungs and stringers permanently in their respective relative positions prevent these ladders from being portable and limit their application to essentially permanent installations.

The use of locking bolts, or latches, to enable retractable ladders to be selectively locked in an extended position also is an established feature of the retractable ladder art. Illustratively, U.S. Pat. No. 2,993,561 granted Jul. 26, 1961 to C. J. Watson for "Collapsible Ladder" shows a spring biased bolt nested within a ladder rung. The biasing spring forces the bolt to protrude through openings in the ladder's legs to lock the ladder in an extended position. Installations of this character, however, can be dangerous, especially when the structure is incorporated in a ladder that is automatically retractable. Thus, by accidentally initiating retraction, a person standing on the ladder can be thrown off balance and seriously injured. Consequently, there is a further need to provide some inexpensive and yet effective means to prevent a ladder from retracting when it is sustaining a load in excess of its own weight.

Ordinarily, automatic retraction of an extended ladder proceeds with increasing velocity, accelerating under gravitational force, until the ladder is fully retracted. This largely uncontrolled high speed retraction can be dangerous to both bystanders and those who are using the ladder. Unquestionably, this need also has been recognized as, for example, in U.S. Pat. No. 3,774,720 granted to C. C. Hovey on Nov. 27, 1973 for "Power-Operated Retractable Ladder For Pleasure Boats," which shows various hydraulic and spring biased ladder extension and retraction structures.

The need remains, however, for a reliable and inexpensive apparatus that will retard ladder retraction speed. Preferably, the desired retarding, or retraction braking mechanism, should be a simple device that uses few, if any, moving parts in order to avoid imposing requirements for maintenance and frequent parts replacement.

These and other inadequacies of the prior art are overcome, in general, through the practice of the invention. For instance, in accordance with the invention, a low coefficient of friction plastic bushing is mounted within a coupling that joins a rung to an associated ladder stile. The coupling, bushing and underlying portion of the stile are mechanically deformed to a degree that keeps the coupling and the bushing in their proper positions relative to the associated stile without otherwise interfering in the ladder's operation. In this manner, a truly portable ladder is now possible without risking an undesired disassembly of the ladder in whole or in part as a consequence of an uncontrolled movement of the couplings relative to their respective stiles.

An additional feature of the invention overcomes the dangerous potential for retraction of a ladder while that ladder is sustaining a load (e.g., a person standing on the ladder). Illustratively, the portion of the latch, or locking bolt that protrudes through the stile to lock the stile and rung combination in an extended condition, has a slight outward and upward slope. This patently small physical change in the latch shape, however, makes it practically impossible to retract the ladder while that ladder is supporting a weight of any significant amount.

Thus, with the weight of a person bearing down on the ladder, the latches that sustain the load each are jammed in an extended position. The applied force, however, that is needed to draw the latches inwardly in order to release the latch mechanism and initiate ladder retraction exceeds by a wide margin the actual strength available in the hands of an ordinary person. Nevertheless, the upward slope of the latches is so slight that this safety feature offers no practical obstacle to the retraction of an unloaded ladder.

In this way, surprisingly important results are achieved through an unusual latch or locking bolt construction.

To retard and to better control ladder retraction velocity, dampers, or plugs, are mounted in the ends of at least some of the hollow stiles from which the side members or frames for the ladder are formed. These dampers, in accordance with the invention, have orifices of appropriately selected diameters. The combination of the hollow stiles and their respectively orificed dampers form pneumatic brakes that retard ladder retraction velocity. Through appropriate choice of orifice diameters, moreover, a desired retraction velocity can be selected for the ladder.

This feature of the invention is particularly noteworthy because it effectively eliminates the dangers inherent in uncontrolled ladder retraction in which only the friction forces between relative moving parts impose any restraint on retraction velocity.

These and other features of the invention are described in more complete detail in the following description of a specific embodiment of the invention, when taken with the figures of the drawing. The scope of the invention, however, is limited only through the claims appended hereto.

DETAILED DESCRIPTION

Figure 1:
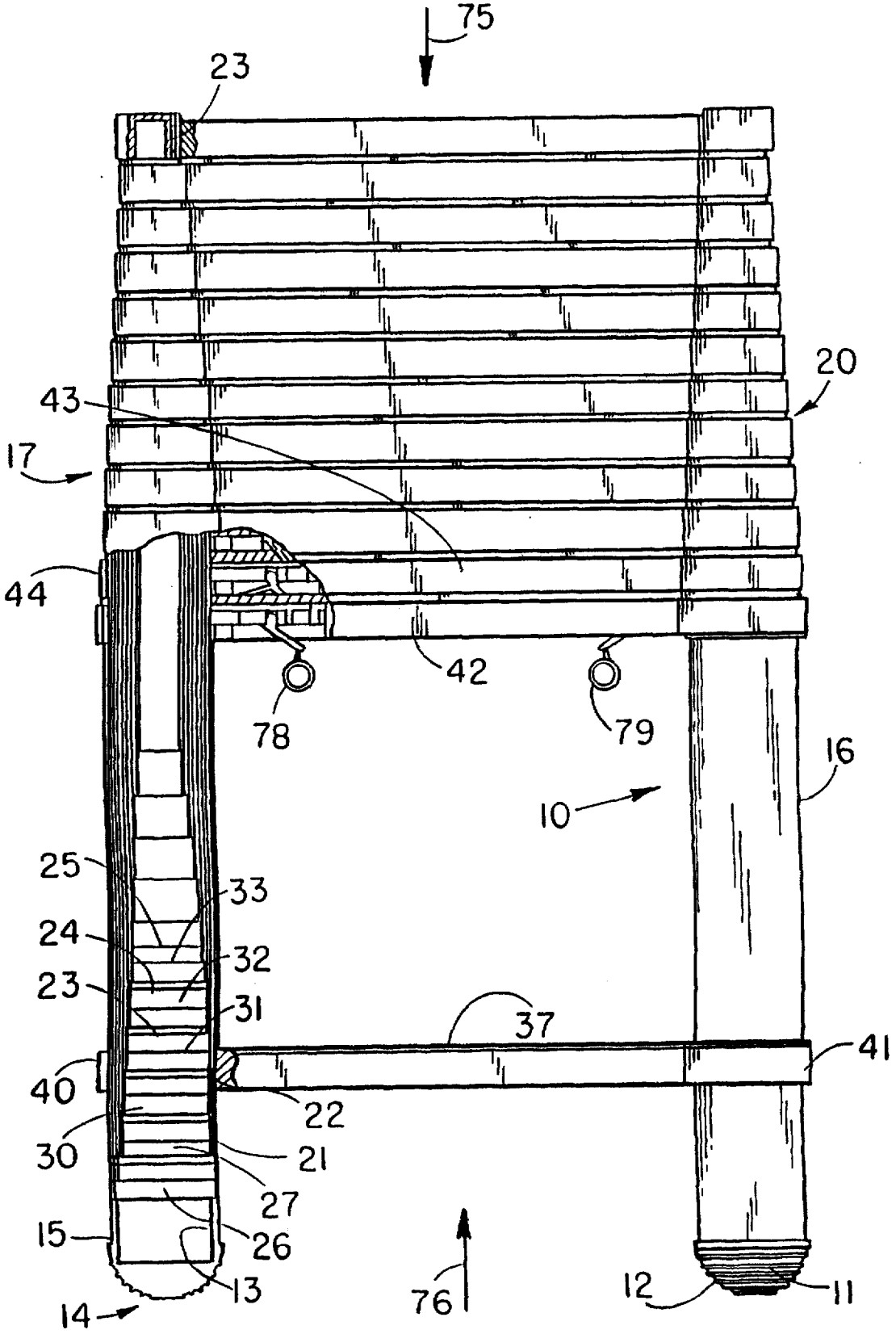
FIG. 1 is a front elevation of a typical embodiment of the invention, in partial section, with the ladder in a fully retracted condition.

For a more complete appreciation of the invention, attention is invited to FIG. 1 which shows an illustrative retractable ladder 10. The ladder 10 has a hemispherical foot 11 that is formed of a suitably high-friction elastic material. Preferably, the foot 11 is made from a non-marking material that is treated to resist structural degradation through ultraviolet radiation from sunlight, and the like. As shown in the drawing, the foot 11 has a concentrically ribbed external surface 12. A cylindrical cuff 13 (shown in full section in connection with foot 14) protrudes from the hemispherical portion of the foot 14. A hollow cylindrical stile 15 has an open end portion that receives the cuff 13 in a very snug fit in order to retain the foot 14 in the open end of the stile 15. A similar construction (not shown in the drawing) is provided for the foot 11 in stile 16.

The stiles 15 and 16 provide housings in which respective arrays of nested, telescoped sets of hollow stiles 17, 20 are received. Although the set of stiles 17 is described in detail it should be noted that the set of stiles 20 enjoys a corresponding, parallel construction. As illustrated, the stiles 15, 16 are of maximum stile diameter. Individual stiles 21, 22 that are nested within the stile 15, for example, are each of a progressively smaller diameter until a last stile 23 in the set of stiles 17 is reached, the last stile 23 having the smallest diameter in the entire set 17.

In accordance with a feature of the invention, the stile 15, the stiles 21, 22 nested immediately within the stile 15 and successively smaller diameter stiles 23, 24, 25 are each provided with respective dampers 26, 27, 30, 31, 32, 33.

Figure 4:
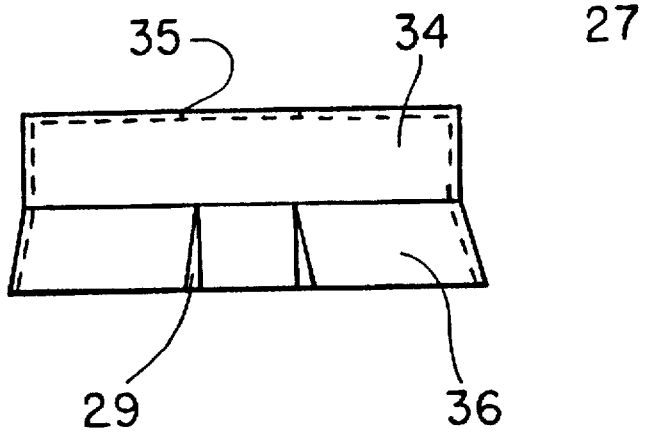
FIG. 4 is a front elevation of a typical damper for selectively retarding the retraction velocity of the ladder shown in FIG. 1.

The damper 27, for example, that is shown in FIG. 4, is made of polyethylene or other suitable plastic material. An annular portion 34 of the damper 27 has a cylindrical aperture 35, that forms the throat of an orifice for controlling the flow of air from the stile 21 (FIG. 1). As described subsequently in more detail, each of the dampers 26, 27 and 30 through 33 has a respective aperture of predetermined diameter to regulate the speed with which the ladder 10 retracts under the force of gravity.

A flange 36, in the shape of a truncated cone protrudes from the base of the annular portion 34. The maximum diameter of the flange 36 is greater than the inner diameter of the cylindrical stile 21 in which the damper 27 is mounted. The flange 36 bears, or presses against the adjoining portion of the inner surface of the next larger adjacent stile in order to keep the stile 21 centered and prevent it from touching the inner surface of the next larger adjacent stile (FIG. 1). Only with the exception of the damper 26 that is mounted in the stile 15, each of the other dampers 27 and 30 through 33 has a respective cut-out 29 in the flange 36. The damper 26, in contrast, has a continuous, uninterrupted conical flange (not shown) that is received within the hollow portion of the stile 15.

The longitudinally parallel stiles 15, 16 are joined together by means of a transversely oriented rung 37 (FIG. 1) that is permanently joined in any suitable way to the outer surfaces of the stiles 15, 16 through brackets 40, 41, respectively.

Figure 8:
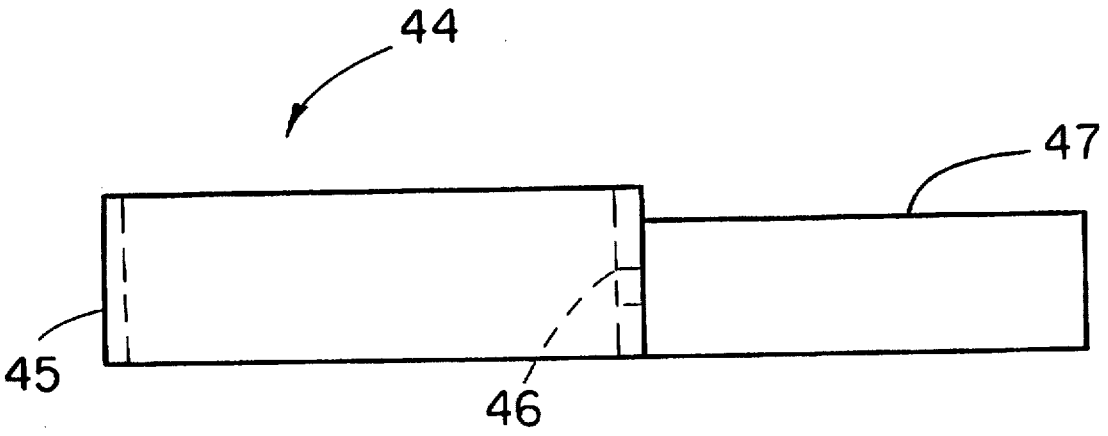
FIG. 8 is a side elevation, in full section, of the illustrative bracket shown in FIGS. 1 and 2.
Figure 2:
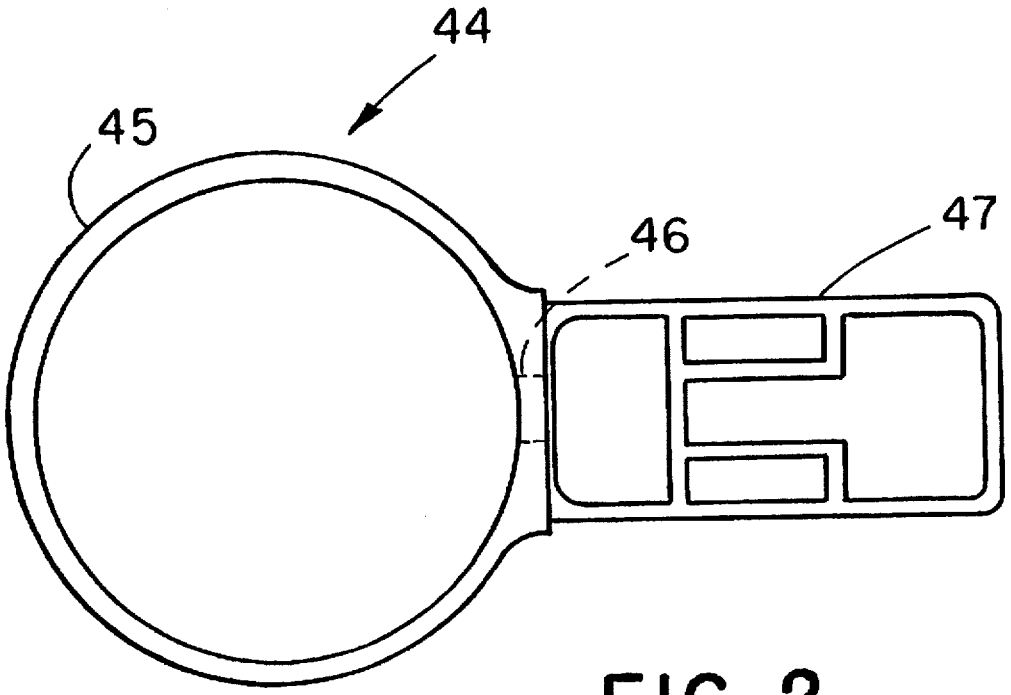
FIG. 2 is a top elevation, in full section, of an illustrative bracket for use in connection with the ladder shown in FIG. 1.
Figure 5:
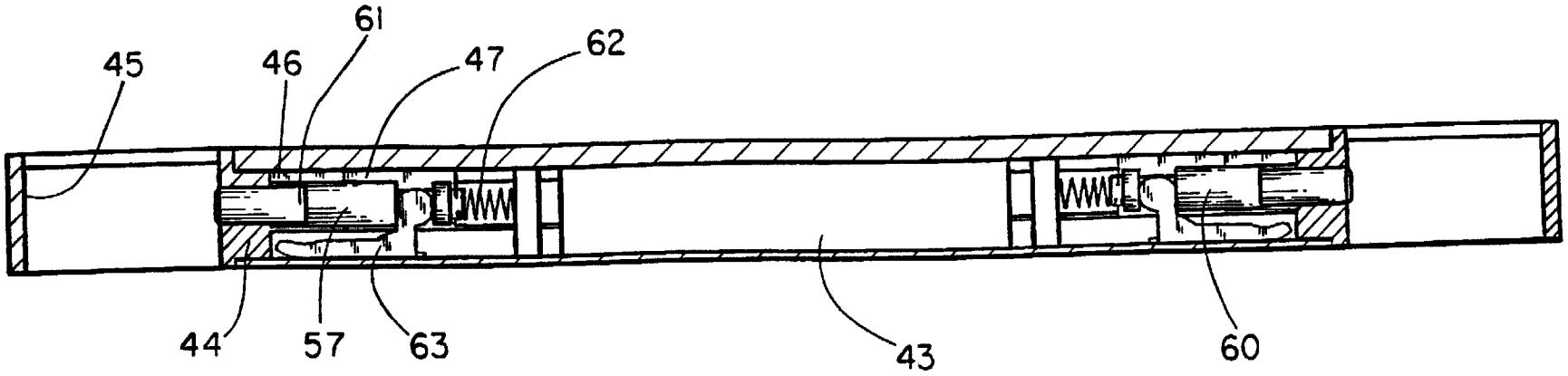
FIG. 5 is a front elevation, in full section, of a rung and latching mechanisms suitable for use with the embodiment of the invention shown in FIG. 1.

Spaced longitudinally from the rung 37 are successive, transversely oriented rungs, of which only illustrative rungs 42, 43 are described in detail. For example, the rung 43 is joined to the outer surface of the stile 22 to which it is attached by means of a loop bracket 44. In accordance with another salient feature of the invention, as shown in FIGS. 2 and 8, the loop bracket 44 has a hollow cylindrical coupling 45, the diameter of which is slightly greater than the diameter of the corresponding outer surface of the stile 22 (FIG. 1) to which it is attached. As shown in FIGS. 2, 5 and 8, a passageway 46 is formed between the coupling 45 and a latch support 47 that protrudes radially from the coupling 45 in order to be received within the rung 43.

Figure 3:
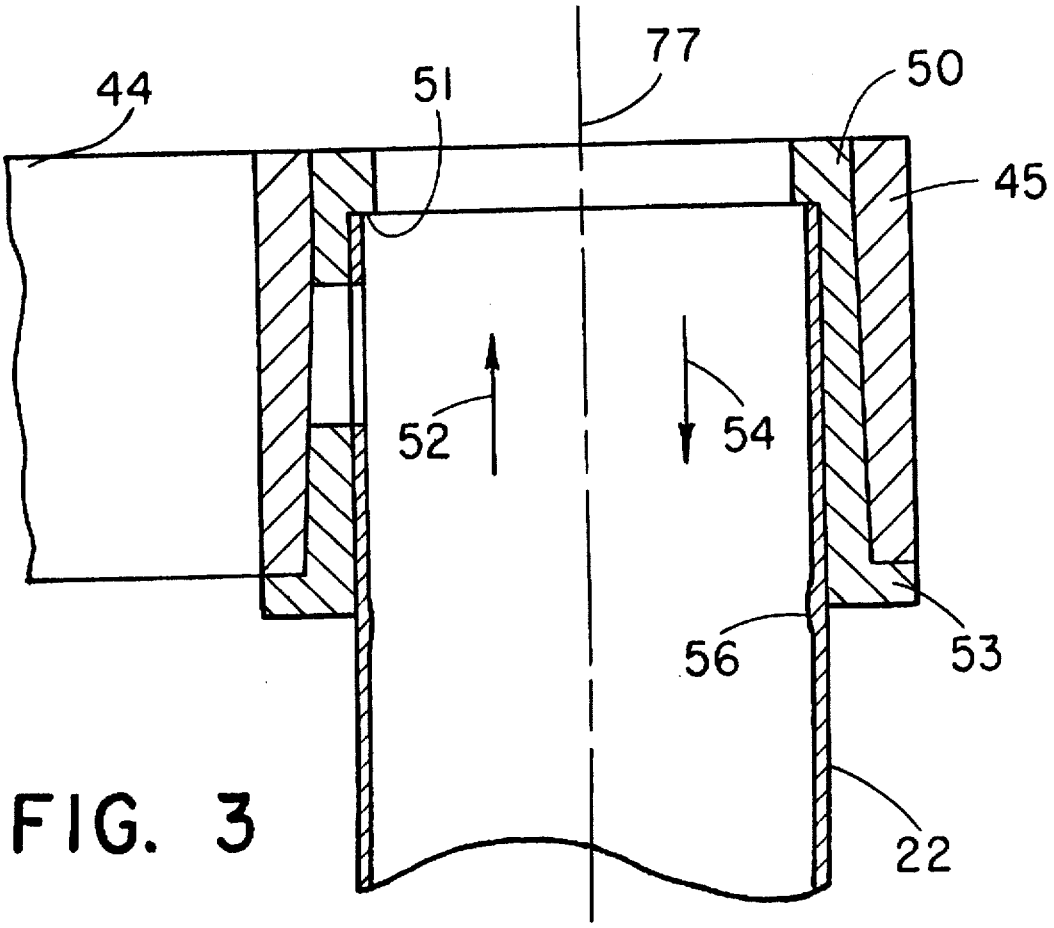
FIG. 3 is a front elevation in full section, of a portion of a typical bracket and bushing combination, joined to a stile in accordance with a further feature of the invention.
Figure 7:
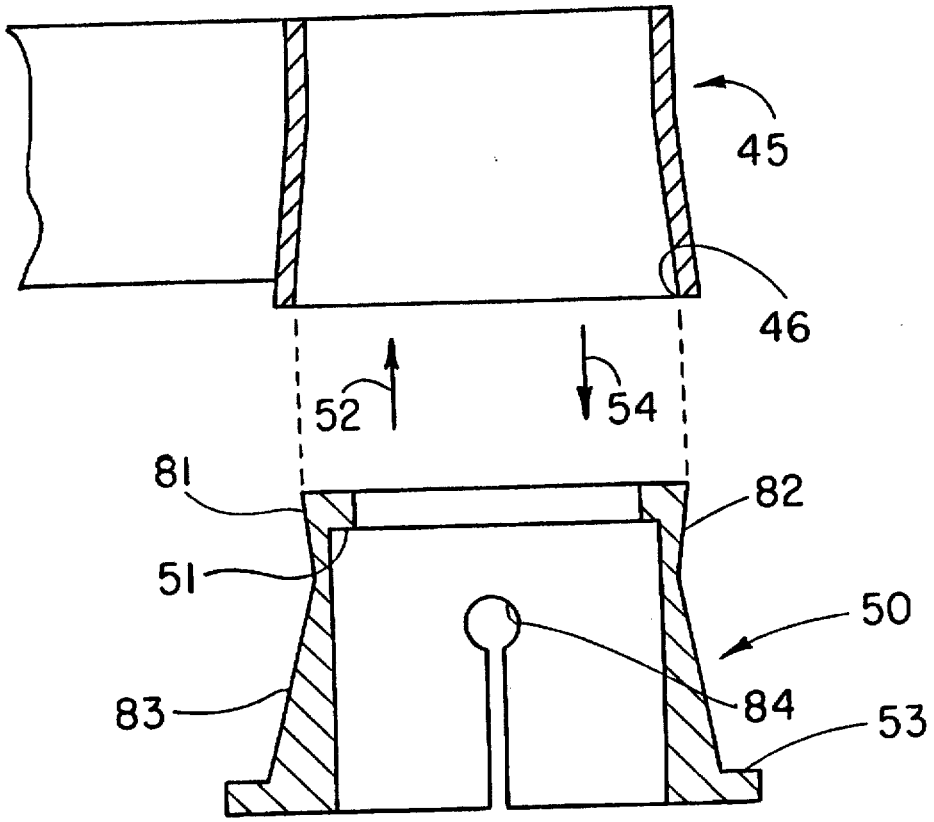
FIG. 7 is a front elevation, in full section, of an exploded assembly view of a typical bracket coupling and bushing for use in connection with ladder shown in FIG. 1.

Turning now to FIG. 3, the coupling 45 encloses a hollow cylindrical bushing 50 formed from a suitably low coefficient of friction plastic bearing material. In accordance with the invention, the bushing 50 has, on one end, a radially inwardly oriented portion or ring 51 that protrudes over and engages the end of the stile 22 to prevent the stile 22 from moving in the longitudinal direction of arrow 52 without drawing the bushing 50 and the loop bracket 44 as a combination in that same direction. The manufacturing process for the bushing 50 has a profile found on its outer surface 81 as shown in FIG. 7, that creates a "draft angle" 82 outward at the top end of the bushing 50 adjacent to the ring 51 and also a longer "draft angle" 83 at the lower end in the vicinity of the flange 53 creating an "hour glass" shape. The flange 53 is equal to or larger in diameter than the coupling 45 (FIG. 3) outside diameter. The coupling 45 inside diameter, as shown in FIG. 7, is also processed to slightly enlarge the lower side of the passageway 46 so that the coupling 45 lower inside diameter can be assembled over the bushing 50 outside diameter at its top end but still be smaller in diameter than the lower outside diameter of the bushing 50 at "draft angle" 83. This assembly takes place during final ladder assembly which is described further on in more detail.

Also in accordance with a characteristic of the invention, the coupling 45 bears against the flange 53 in order to block the coupling 45 from moving in the longitudinal direction of arrow 54. The "locking" in position of the profiles prevents independent movement of the coupling 45 in the longitudinal direction of arrow 52.

To complete the assembly of this portion of the ladder, the coupling 45 is placed in contact with the bushing outer surface 81 on the ring 51 end. Then the coupling 45 is pressed in the direction of the arrow 54 to bear firmly against the flange 53 [this is facilitated by the slot (not shown) in the bushing 50] and to "lock" with the hour glass type shape of the bushing 50 and the coupling 45. This compresses the bushing 50 radially toward the center of the stile 22 with sufficient force to deform, slightly, the stile 22 in the vicinity of the flange 53. Thus, as shown in FIG. 3, an annular, inwardly oriented, bulge 56 is formed in the inner surface of the stile 22 in general alignment with the compressed flange 53. The diameter of the stile 22 in the plane of the maximum penetration of the bulge 56 into the interior of the stile, however, is greater than the internal diameter of the ring 51. In this way the low coefficient of friction that characterizes the material from which the bushing 50 is formed enables the inner surface of the ring 51 to stabilize and form a smooth bearing surface for the telescoping stile 23 (FIG. 1) that is received within the stile 22. The bulge 56 (FIG. 3), moreover, having a greater diameter than the inner diameter of the ring 51 does not interfere with the relative movement of the stiles 22 and 23 in the directions of the arrows 52, 54.

Attention now is invited once more to FIG. 5 in which latch mechanisms 57, 60 are mounted in the rung 43. The latch mechanism 57, for example, is mounted in the latch support 47. A latch, or locking bolt 61 is seated in the passageway 46, biased through a spring 62 and lever 63 to protrude, selectively through the passageway 46 and into the interior of the coupling 45.

A companion hole (not shown in FIG. 5) is formed in the adjoining surface of the stile 23 (FIG. 1) that is telescopically received within the stile 22 and which is secured in the coupling 45. When the stile is extended to erect the ladder, or a portion of the ladder, the hole (not shown in FIG. 5) in the telescoped stile 23 aligns with the latch 61 to enable the latch 61 to protrude into and to selectively lock the stiles 22, 23 together in an extended position.

Figure 6:
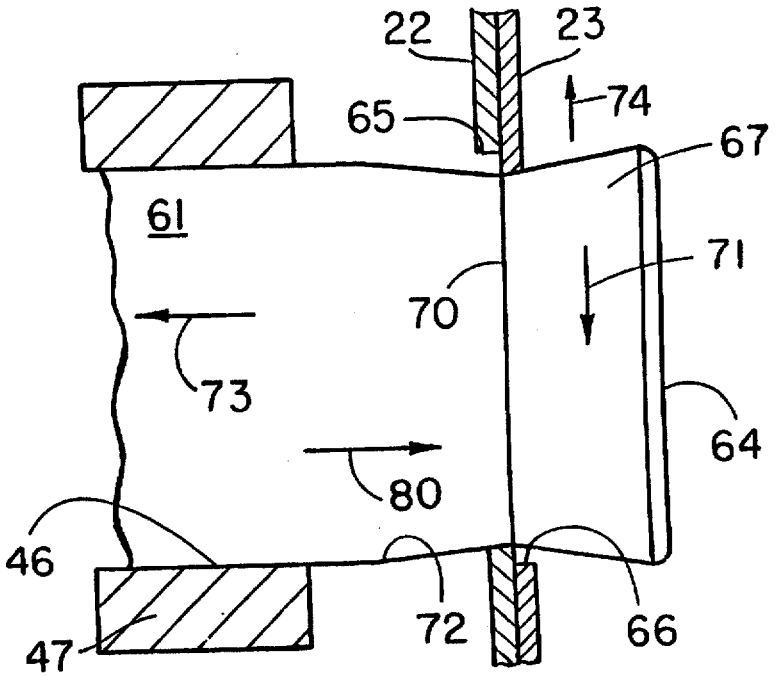
FIG. 6 is a front elevation, not drawn to scale, of a portion of the latch that is shown in FIG. 5 to illustrate an additional feature of the invention.

In accordance with a further salient feature of the invention, attention now is invited to FIG. 6 which shows an end 64 of the latch 61 that protrudes through the passageway 46 in the latch support 47. As shown, the end 64 penetrates aligned holes 65, 66 in stiles 22 and 23, respectively. In this manner, the latch 61 selectively locks the two stiles 22, 23 together to keep that portion of the ladder 10 (FIG. 1) in an extended position.

The end 64 of the latch 61, moreover, has a surface 67 that slopes away from the end 64 toward the longitudinal axis of the latch 61 and the stiles 22, 23 at an angle of about 5°, terminating in a low point, or a plane 70 of minimum latch thickness that is perpendicular to the longitudinal axis of the latch 61. The portion of the latch 61 in the plane 70 sustains the load on the ladder that is applied in a direction transverse to the longitudinal axis of the latch 61, as that load is transmitted by the stiles 22, 23 to the latch 61 in the direction of arrow 71.

Proceeding away from the end 64 of the latch 61 and the plane 70 of minimum latch thickness, surface 72 on the latch 61 slopes upwardly at an angle of about 5° toward the passageway 46 in the latch support 47 until the thickness of the latch in a plane transverse to the longitudinal axis of the latch 61 is only slightly less than the corresponding passageway dimension.

In this way, the latch 61 can be pressed through the aligned holes 65, 66 in the stiles 22, 23, respectively, to enable the stiles to bear against the latch 61 in the vicinity of the plane 70 that establishes minimum latch thickness. To retract the stiles 22, 23 relative to each other, it is only necessary to draw the latch 61 lengthwise, or longitudinally in the direction of arrow 73 by manipulating levers 78, 79 (FIG. 1) through a distance that will enable the end 64 (FIG. 6) of the latch to pass through the holes 65, 66 and clear the stiles 22, 23.

In a condition in which the ladder is sustaining only its own weight, a longitudinal application of manual force to the levers 78, 79 (FIG. 1) or automatic retraction force is sufficient to overcome the force of the spring 62 (FIG. 5) and the spring (not shown) in the opposite end of the rung 43 and press the stiles 22, 23 upwardly against gravitational force in the direction of arrow 74 to enable the latch 61 to be drawn in the direction of the arrow 73. Should the ladder support a significant load (in addition to its own weight), however, the additional force created by this extra weight in the direction of the arrow 71 will be so great that manual release, or even automatic release of the stiles 22, 23 will not be possible. Thus, the friction force created by the force of the stiles 22, 23 normal to the latch 61 and the force required to move the stiles 22, 23 up the inclined plane formed by the sloping surface 67 cannot be overcome through manual or automatic force applied to the latch 61 in the longitudinal direction of the arrow 73.

In operation, the ladder 10 (FIG. 1) is assembled by placing bushings on and over the side of the respective stiles and mounting couplings on the bushings. Latch mechanisms are mounted within individual latch supports with the associated latches protruding through the passageways in the brackets in which they are mounted. The latch supports are then received within respective rungs to form a rung and stile combination for each of the rungs in the ladder as best illustrated in FIGS. 3 and 5 of the drawings.

Further in this regard, dampers 26, 27 and 30 through 33 are installed in the lower six stiles in the sets 17, while a companion set of dampers (not shown) is mounted in the set of stiles 20. The dampers are pressed into the open ends of their respective stiles that are opposite to the ends of the stiles 15, 16 that receive the respective feet 11, 14. As best illustrated in FIG. 4, the flange 36 is pressed into the associated stile (not shown in FIG. 4) to enable the flange to bear against the adjoining portion of the inner wall of the stile.

When the entire ladder in initially assembled with the rungs, latch mechanism and stiles all in place the entire ladder 10 (FIG. 1) is compressed, lengthwise in the directions of arrows 75, 76. This compression of the assembled ladder permits the illustrative coupling 45 (FIG. 3) to be pressed in the direction of the arrow 54, over the slotted bushing 50 enabling the illustrative coupling 45 to pass over the slotted bushing 50 and bear against the flange 53 while "locking" the two similar hour glass shapes of the coupling 45 and the bushing 50 in an essentially permanent combination.

A most subtle feature of the invention, is the manner in which the lower draft angle in the vicinity of the flange 53 of the bushing 50 is used to form a permanent connection between the coupling 45, the bushing 50 and the stile 22. Thus, as mentioned above, when the bushing 50 is manufactured, the outer diameter of the bushing in the plane of the flange 53 is slightly greater than the lower internal diameter of the coupling 45. The inner diameter of the coupling 45 is formed during manufacturing to have a similar but smaller hour glass profile to the outside diameter of the bushing 50. This creates a "locked" connection between the coupling 45 and the bushing 50 after assembly, as subsequently described.

In this manner, when the end of the coupling 45 is pressed against the flange 53, the coupling 45 presses the bushing inwardly, in a radial direction, toward longitudinal axis 77 of the stile 22. Thus, the compressive force applied by the coupling 45 to the bushing 50 as the coupling is being pressed into position in the direction of the arrow 54 also produces the deformation, or the bulge 56 that secures the stile 22, the bushing 50 and the coupling 45 in proper relative position. The bulge 56, moreover is produced to a depth that will not impair the strength of the stile or interfere with the movement of the stiles 22 and 23 relative to each other in the directions of the arrows 52, 54. Significantly, this result is achieved without resort to a further manufacturing operation.

Having fully assembled the ladder 10 (FIG. 1), the ladder then is extended by drawing the stiles in the sets 17, 20 apart in the direction of the arrow 76. As shown in the illustrative example in FIGS. 5 and 6, as the stile 23 is drawn in the direction of the arrow 74, the aperture 66 in the stile 23 aligns with the aperture 65 in the stile 22 to permit the latch 61 to pass through the aperture in the direction of arrow 80 in response to the biasing force applied by the spring 62 in the latch mechanism 57. Upon application to the ladder of a load that is significantly greater than the weight of the ladder (e.g., sustaining the weight of a normal person), the force of gravity draws the stiles 22, 23 down the sloping surface 67 to the low point formed in the plane 70 of minimum latch thickness.

If there is an attempt to retract the ladder, by drawing the latch 61 in the direction of the arrow 73, to thus move the end 64 of the latch 61 out of the holes 65 and 66, the friction force generated by the stiles 22, 23 in response to the normally applied load and the force required to raise the stiles 22, 23 up the inclined plane on the surface 67 against gravitational force is just too great for the manual strength available to most people and the mechanical advantage available through the latching mechanism.

On relieving the extra load on the ladder, however, to create a condition in which the only force pressing normally to the surface 67 on the latch 61 is the weight of the portion of the ladder that is above the latch, the latch 61 can be drawn in the direction of the arrow 73 with relative ease because the frictional force is reduced considerably and the approximate 5° slope of the surface 67 is easily overcome with the lower load.

As a result, while a person is standing on the extended ladder it is not practically possible to initiate automatic retraction of the ladder rungs. In contrast, however, an unloaded ladder can be retracted through latch mechanism manipulation with only limited force.

The damper orifice, of which the orifice 35 in FIG. 4 is typical, restricts the flow of air through the orifice throat. In this way, the airflow restriction through the sequence of orifices in the dampers 26, 27, and 30 through 33, as well as the companion dampers (not shown in the drawing) in the set of stiles 20 retard the retraction velocity of the stiles as they telescope together, the dampers in this way reduce the ladder retraction velocity to a predetermined value that is less than the velocity which otherwise would be reached through an unimpeded force of gravity. The retraction velocity in particular can be established through appropriate orifice diameter choices for the individual dampers.

The distribution of the dampers among the individual stiles also is subject to a wide range of choice. For instance, if the ladder 10 (FIG. 1) is to retract in a downward direction, that is, from the top down in the direction of the arrow 75, it might be preferable to mount the dampers in the smaller diameter stiles, near the top of the ladder. Should the ladder retract in the direction of the arrow 76, from the bottom rung 37 to the top rung, the damper location shown in FIG. 1 has been found to be preferable.

Thus, there is provided accordance with the invention, a retractable ladder in which the ladder components are permanently joined in an efficient manner to provide low coefficient of friction stile interfaces without requiring additional manufacturing steps. An inexpensive and reliable latch construction also is made available that prevents inadvertent release of the ladder while that ladder is supporting a load in excess of the ladder's own weight. Further in this connection, a retraction velocity control also is provided to retard the speed of retraction through an inexpensive mechanism that has no moving parts, thereby requiring minimum maintenance and parts replacement.

What is claimed is:

1. A retractable ladder having several rungs and a plurality of telescoping stiles joined thereto in which the stiles are hollow and have two ends comprising a low coefficient of friction plastic bushing having two ends, said bushing being on one end of at least one of the stiles, a portion on one end of said bushing protruding over and across the end of the stile to extend over and engage at least a part of said stile end to prevent relative longitudinal movement between said stile and said bushing, a flange formed on the other bushing end, a coupling integral with said rung bearing against said flange and in engagement with said bushing to join the stile to the rung associated therewith.

2. A retractable ladder having several rungs and a plurality of telescoping stiles joined thereto in which the stiles are hollow and have two ends comprising a low coefficient of friction plastic bushing having two ends, said bushing being on one end of at least one of the stiles, a portion on one end of said bushing protruding across the end of the stile to extend over a part of said stile end, a ledge formed on the outside of said bushing, a flange formed on the other bushing end, a coupling integral with said rung bearing against said flange and in engagement with said ledge to join the stile to the rung associated therewith, and a first bushing dimension near the portion on one end thereof and a second bushing dimension near the flange, said second bushing dimension being greater than said first dimension, whereby said coupling compresses said bushing at said second dimension, said compressed bushing forming a bulge an inner surface of an adjoining stile portion, said bulge protruding into the hollow interior of the stile a shorter distance than said protruding bushing portion.

3. A retractable ladder having a plurality of hollow, longitudinally oriented telescoping stiles and rungs, each of the rungs being individual to a respective one of the stiles, each rung comprising a latch support, said latch support having a passageway oriented toward a respective stile, the stiles each having a hole formed therein for selective registration with a corresponding hole in an adjoining telescopically housed stile, a latch within said passageway for selective penetration through said registered holes to lock said stiles in their respective positions, said latch having an end for protruding through said holes and into said stiles, said latch having a sloping surface formed thereon, to slope to a low point on said latch surface toward said latch support, whereby said latch end is higher than said registered stile holes.

4. A retractable ladder having a plurality of latches and hollow, longitudinally oriented telescoping stiles with two ends, said stiles comprising at least one damper mounted in one of the stile ends, said damper having a generally transverse surface with an aperture formed therein to provide an orifice, a portion on said damper protruding from said stile end and supporting said transverse surface and a surface extending from said portion and protruding outwardly therefrom to engage an inner adjoining surface of a next larger stile, said surface extending from said portion further having a discontinuous surface from which a portion of said discontinuous surface has been cut out to facilitate latch engagement.

5. A retractable ladder for sustaining a weight comprising two parallel sets of stiles, each of said sets of stiles having a longitudinal telescopic array of nested hollow stiles for selective extension and retraction, successive pairs of the stiles having holes formed therein for registration with each other with the stiles extended relative to each other, rungs transversely disposed between pairs of parallel stiles, couplings integral with each rung joining the rungs to the respective stiles, a low coefficient of friction plastic bushing mounted between each of the couplings and an adjoining stile portion, the coupling compressing a part of the bushing against the stile to form a protrusion within the stile, a ring formed on the bushing opposite to said compressed part, the inner dimension of the ring being smaller than the dimension established by the protrusion within the stile, the ring providing a smooth bearing surface for the stile nested within the bushing and the stile associated therewith, a flange formed on the bushing at said compressed part, the coupling bearing against said flange, a ledge formed near the ring in contact with the coupling to restrain movement of the coupling relative to the bushing, a damper in at least one of the hollow stiles, said damper having an orifice formed in the surface thereof to selectively regulate the flow of air therethrough to retard stile retraction, and a latch having an end for protrusion through the registered holes in one of the successive pairs of extended stiles, a sloping surface extending along said latch and toward said registered holes to form a low point on said latch relative to said latch end to prevent said latch from being withdrawn from said registered holes when the ladder is sustaining a weight.

* * * * *